US005524546A

United States Patent [19]

Rozner et al.

[11] Patent Number: 5,524,546

[45] Date of Patent: Jun. 11, 1996

[54] BREECHING DEVICE

[75] Inventors: Alexander G. Rozner, Potomac; Bernard P. Howder, Adelphi, both of Md.

[73] Assignee: The United States of America as represented by the Secretary of the Navy, Washington, D.C.

[21] Appl. No.: 497,588

[22] Filed: Jun. 30, 1995

[51] Int. Cl.[6] ..... F42D 5/00; F42B 1/02

[52] U.S. Cl. ..... 102/303; 102/302; 102/307; 102/310; 102/202.7

[58] Field of Search ..... 102/302, 303, 102/307, 310, 202.5, 202.7

[56] References Cited

U.S. PATENT DOCUMENTS

| | | | |
|---|---|---|---|
| 2,839,997 | 6/1958 | Church et al. | 102/307 X |
| 4,315,463 | 2/1982 | Arcand | 102/303 |
| 4,354,433 | 10/1982 | Owen | 102/307 |
| 4,788,913 | 12/1988 | Stroud et al. | 102/202.5 |
| 4,856,430 | 8/1989 | Gibb et al. | 102/307 |
| 5,080,016 | 1/1992 | Osher | 102/202.7 |
| 5,149,911 | 9/1992 | Ringbloom et al. | 102/302 |
| 5,249,534 | 10/1993 | Sacks | 102/303 X |
| 5,370,054 | 12/1994 | Reams et al. | 102/202.5 |
| 5,377,594 | 1/1995 | Alford | 102/308 |

*Primary Examiner*—Peter A. Nelson
*Attorney, Agent, or Firm*—Roger D. Johnson

[57] ABSTRACT

A breaching device comprising a regular polygon structure in which identical, rectangular, concave flying plate devices (shape charges) form the sides of the polygon, and a strong, rigid, lightweight structure holds the flying plate devices in position. The flying plate devices are identical and comprise a copper or copper alloy plate having a uniform thickness and a concave front face, a uniform elastomeric material layer attached to and covering the back convex surface of the metal plate, and a uniform layer of high energy plastic-bonded explosive covering the back of the layer of elastomeric material. The flying plate devices are oriented so that when simultaneously fired they fly in trajectories that are parallel to each other and perpendicular to the plane of the polygon.

7 Claims, 4 Drawing Sheets

BREECHING DEVICE

BACKGROUND

This invention relates to explosive devices and more particularly to explosive devices for breaching barriers.

Barriers (doors, walls, etc.) made of materials such as steel, rolled homogenous armor, or steel-reinforced concrete are difficult to breach by conventional techniques. Explosive charges must be placed direct against the barrier and very large charges are required to breach the barrier. Frequently, concrete is blown away but an impassible net of steel reinforcement bars is left in place.

Flying metal plates have been used to cut clean holes in steel, armor, or steel reinforced concrete. The steel bars reinforcing the concrete are cut away with the concrete. However, some residual steel bars may be retained in the concrete. Relatively small charges of explosive are used and the damage is substantially confined to the portion of the barrier being breached. Even so a flying plate device which will produce a suitably large entry hole will be very heavy and difficult to handle. For example, a flying plate device weighing about 175 pounds is needed to produce a 24 inch diameter hole in 1.2 inch thick rolled homogeneous armor. It would be desirable to provide a device that will produce the same hole but which is much lighter and easier to carry.

SUMMARY

Accordingly, an object of this invention is to provide a new device capable of producing large holes in steel, armor, or steel reinforced concrete structures.

Another object of this invention is to provide a new lightweight device for producing large diameter holes in steel, armor, or steel reinforced concrete structures.

These and other objects of this invention are accomplished by providing: a breaching device comprising a regular polygon structure in which identical, rectangular, concave flying plate devices form the sides of the polygon, and a strong, rigid, lightweight structure holds the flying plate devices in position. The flying plate devices are identical and comprise a copper or copper alloy plate having a uniform thickness and a concave front face, a uniform elastomeric material layer attached to and covering the back convex surface of the metal plate, and a uniform layer of high energy plastic-bonded explosive covering the back of the layer of elastomeric material. The flying plate devices are oriented so that when simultaneously fired they fly in trajectories that are parallel to each other and perpendicular to the plane of the polygon.

DESCRIPTION OF THE DRAWINGS

Various other objects, features, and attendant advantages of the present invention will be more fully appreciated as the same becomes better understood when considered in conjunction with the accompanying drawings, in which like reference characters designate the same or similar parts throughout the several views and wherein.

DESCRIPTION

Figure 1:
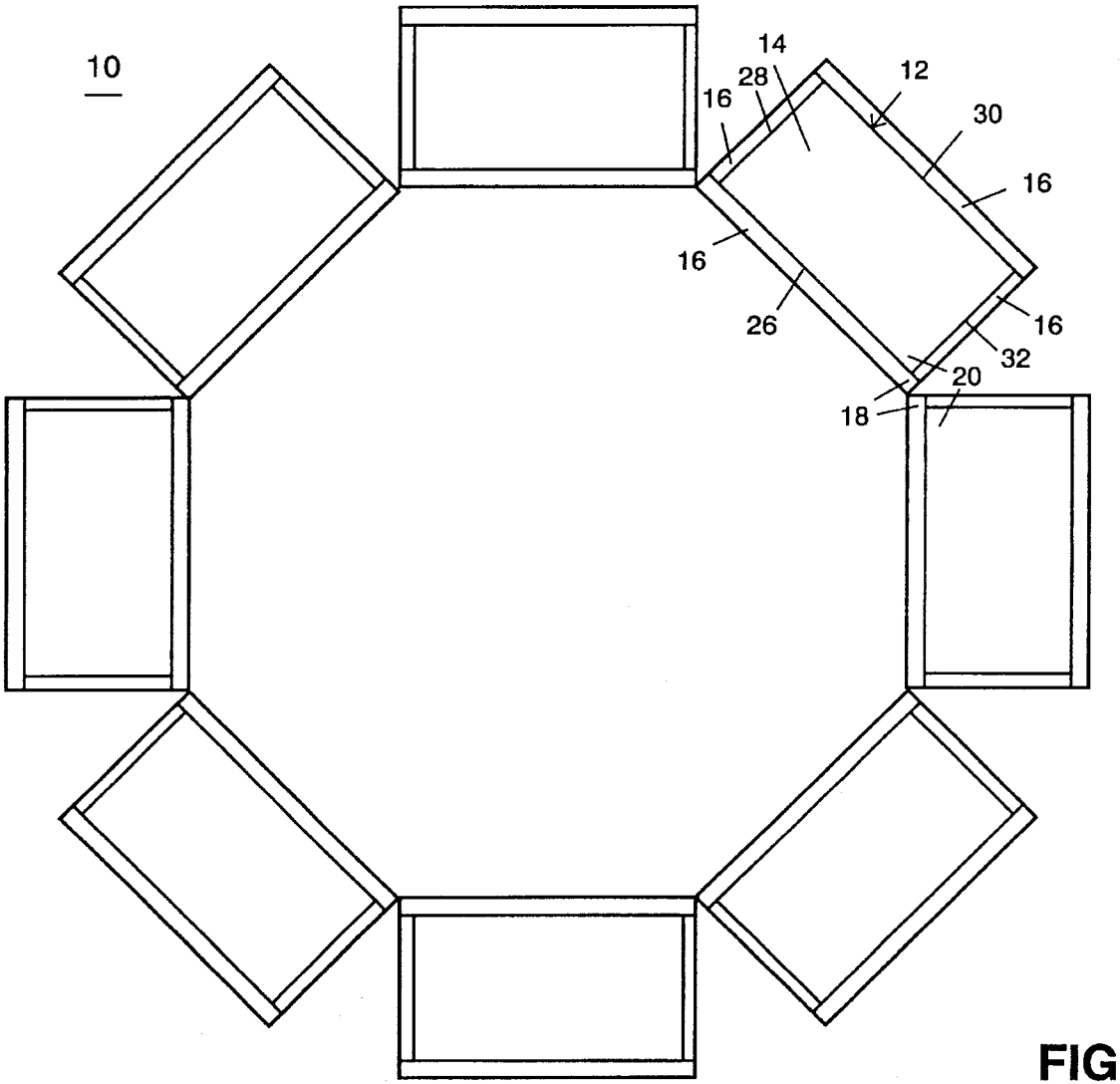
FIG. 1 is a schematic front view of an octagonal breaching device showing the eight rectangular flying plate devices and the structure which holds them in plate.

The breaching device of the present invention is an array of identical linear flying plate devices which form the sides of a regular polygon. A lightweight, rigid structure of a suitable material such as wood or plastic holds the linear flying plate devices in position. The linear flying plate devices are oriented so that when the breaching device is fired normal to a flat barrier surface all the rectangular flying plates projectiles from the devices will strike the barrier surface at the normal (perpendicular to). Means are provided to fire all the flying plate devices simultaneously, resulting in the identical flying plate projectiles striking the target simultaneously. A hole the size and shape of the breaching device polygon is produced in the barrier. This breaching device may be used in air or underwater.

Theoretically, the number of sides in the polygon of the breaching device may be 3 or more. However, reliable triangular (3 plates) devices are difficult to fabricate and they produce very small holes. Reliable square (4 plates) devices are easy to make and they produce large holes which are suitable for many purposes. For example, the holes may be used as firing ports for weapons or for allowing water or other liquids to flow in or out of confined spaces such as storage tanks or ships. However, square holes, with their sharp corners, are not suitable for the fast entrance or exit of personnel into or out of confined spaces. A circular hole, with no corners, is ideal for this purpose. As the number of sides increases, a polygon becomes more like a circle. However, as the number of sides increases the polygonal breaching device also becomes heavier and less reliable. Therefore, the regular polygonal breaching device should have 4 or more sides, preferably from 4 to 12 sides, more preferably from 6 to 10 sides, and most preferably 8 sides.

The regular polygonal breaching devices of this invention may be used on land (in air) or underwater. They are light enough for one man to easily handle. They are able to produce a hole in to 4 inches or rolled homogenous armor or in to 16 inches of steel bar reinforced concrete that is large enough for a man to get through.

FIG. 1 shows a front schematic view of a regular octagonal breaching device 10 according to this invention. Eight identical 4⅛ inch by 6½ inch rectangular flying plate devices 12 are framed in ½ inch plywood 16 and the frames 16 are brought together to form an rigid octagon structure with the internal corner 18 of adjacent frames 16 being in contact. This results in the internal corners 20 of the rectangular flying plate devices 12 also being brought into close proximity. The portion of each flying plate device 12 shown is the concave front face of the metal plate 14 which forms the front of the device 12. The distance between the centers of opposite linear shape charges 12 is 22 inches which is the size of the hole produced in the target barrier. The barrier material within the polygon is blown out of the barrier. The 4 front edges 26, 28, 30, and 32 of each of the 8 eight rectangular flying plate devices 12 lie in the plane of a regular polygon (octagon). In other words all the front edges of all the rectangular flying plate devices 12 (32 front edges) lie in the same plane. When the eight devices are simultaneously fired they each follow a path perpendicular to the plane of the octagon and parallel to the other seven devices.

Figure 2B:
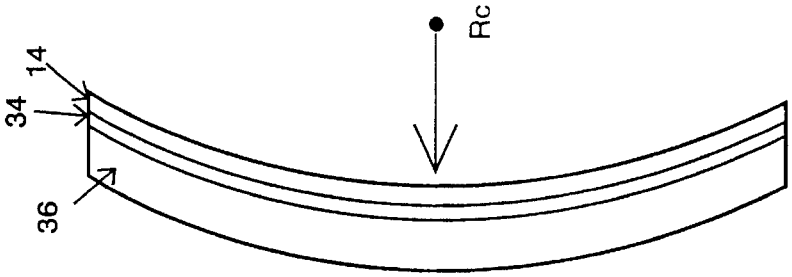
FIGS. 2A, 2B, and 2C are schematic front, side cross-sectional, and back views, respectively, of a single rectangular flying plate device.
Figure 2A:
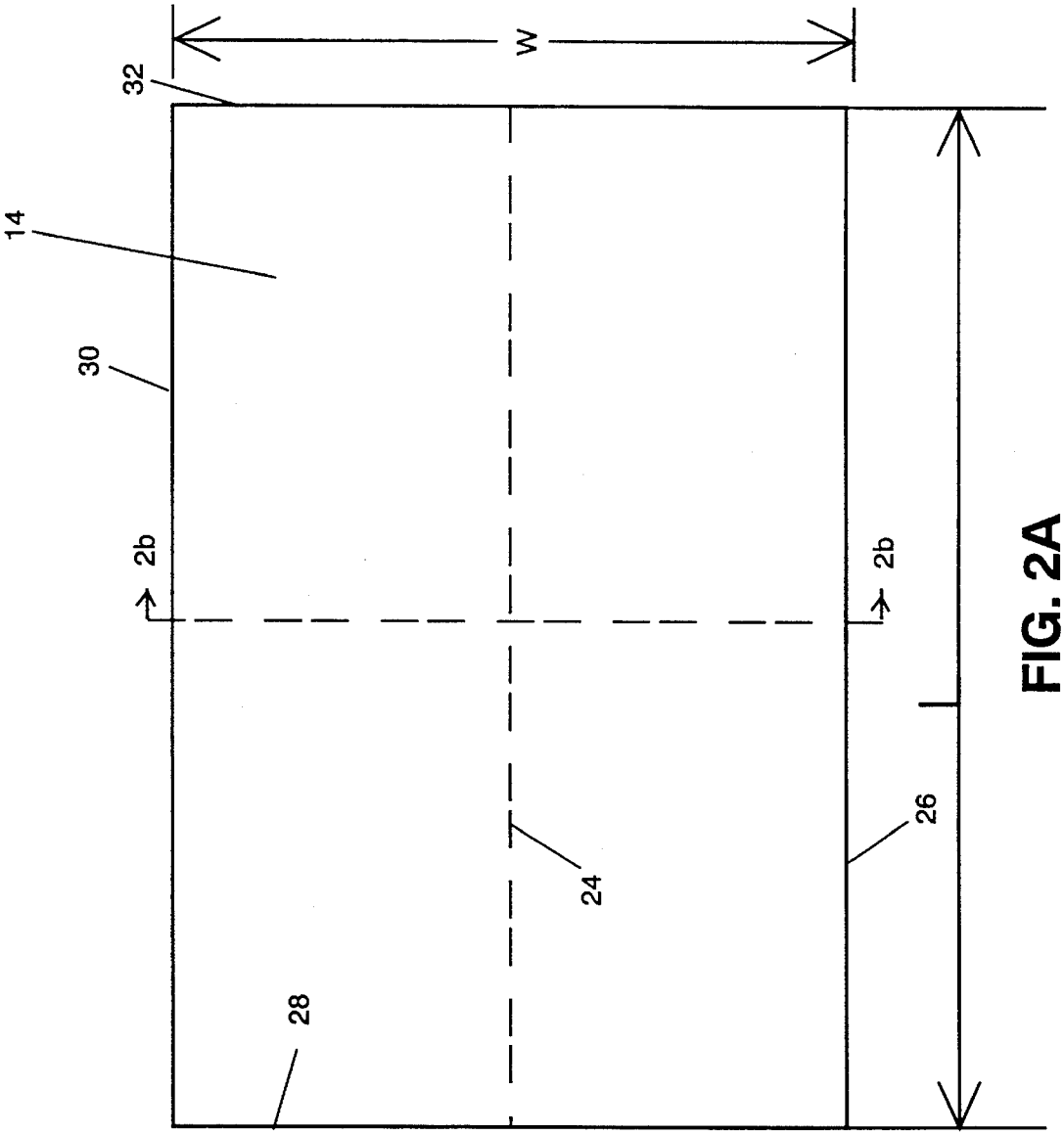
Figure 2C:
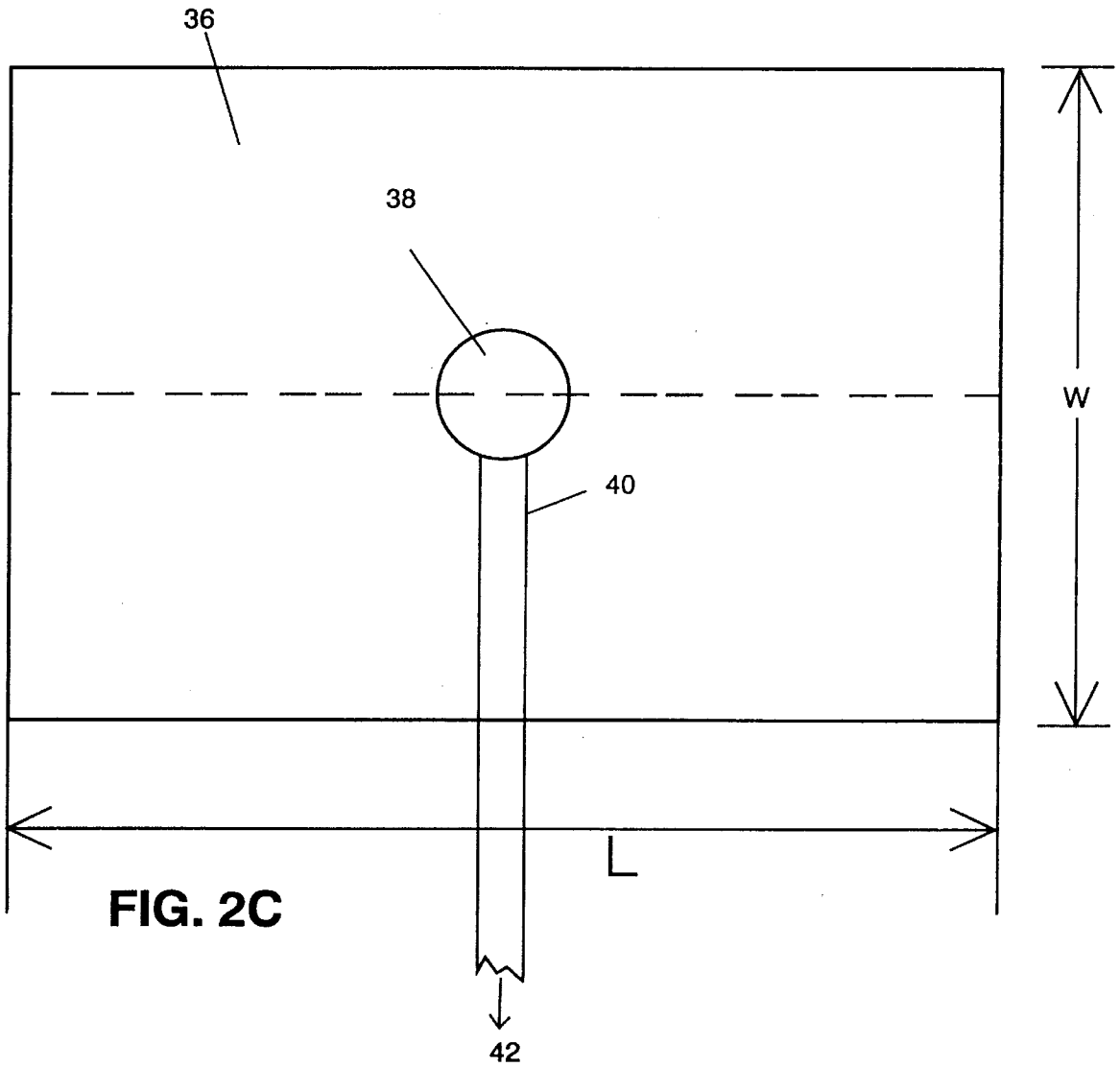

FIGS. 2A, 2B, and 2C show one of the identical rectangular flying plates 12. FIG. 2A shows the rectangular flying plate device 12 as viewed at its symmetrical concave metal plate 14 front face. The deepest points of concavity are located at the line 24 which runs lengthwise alone the center of the plate. The front edges 26, 28, 29, and 30 of this metal plate 14 are the front edges 26, 28, 30, and 32 of the rectangular flying plate device 12. Also labeled are the width W and length L of the plate. FIG. 2B is a cross-sectional side view of the linear flying plate device 12 taken through the center of the device perpendicular to center line 22 as shown in FIG. 2A. Shown in FIG. 2B is the concave metal (copper) plate 14 of uniform thickness, a uniform layer of a conventional strong, flexible elastomeric material 34 attached to and covering the convex back face of the metal plate 14, and a uniform layer of a conventional high energy plastic bonded explosive 36 (such as C-4) attached to and covering the back surface of the elastomeric material 34. FIG. 2C shows the rectangular flying plate device as viewed at its convex back with the layer of high energy plastic bonded explosive 36 showing. Also shown is a booster explosive 38 which is located at the center of the energetic plastic bonded explosive layer 36. A detonation cord 40 connects the booster explosive 38 to a detonator 42 (not shown).

Figure 3:
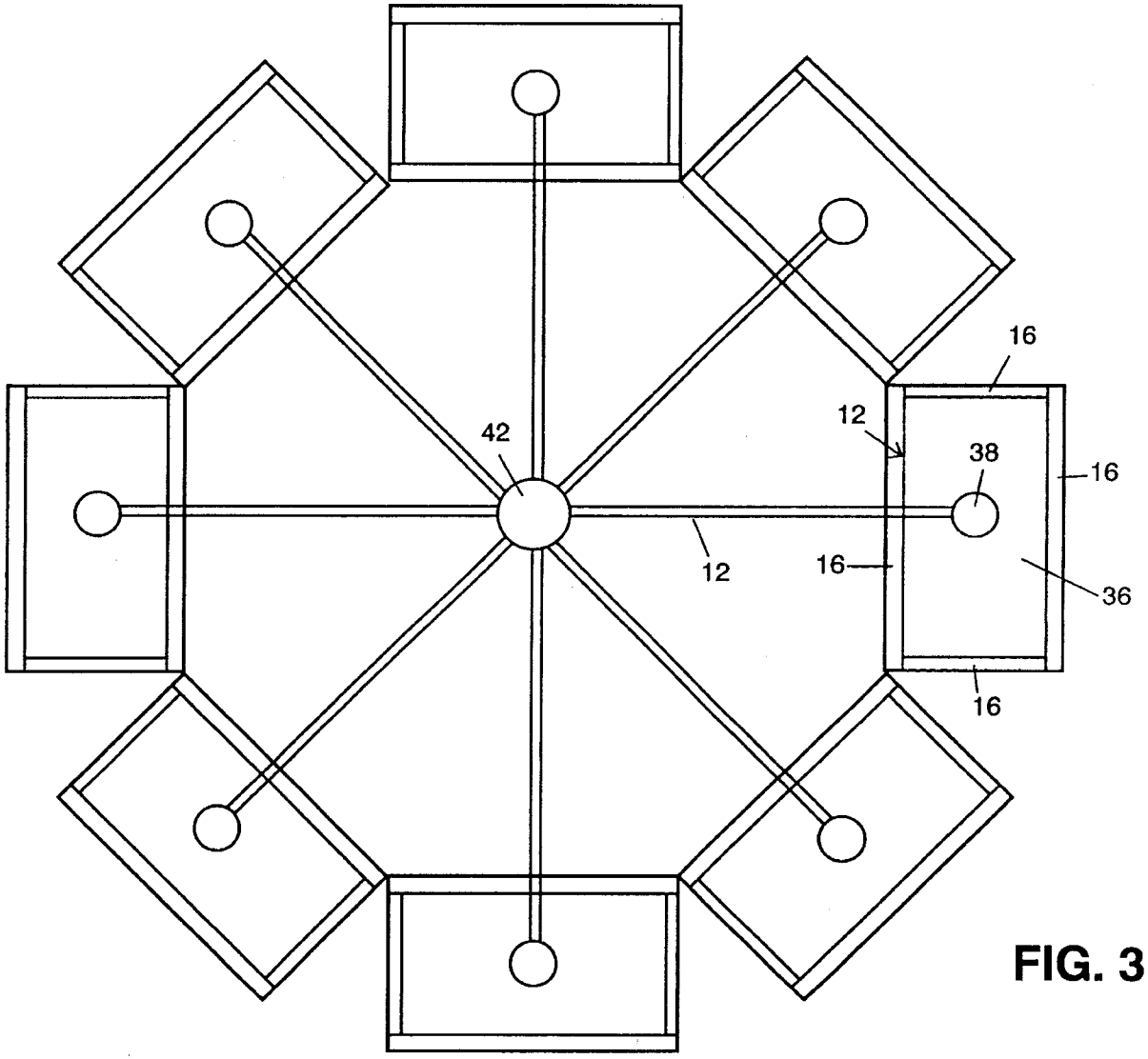
FIG. 3 is a schematic rear view of the octagonal breaching device including the eight flying plate devices, the structure holding them in place, and means for simultaneously detonating the flying plate devices.

FIG. 3 shows the rear schematic view of the regular octagonal breaching device 10 with the booster explosives 38, detonation cords 40, and single detonator 42. The 8 sides of the regular octagonal breaching device 10 are bounded by 8 identical rectangular flying plate devices 12. Shown are 8 identical booster explosives 38 which are located at the center of the uniform, high energy explosive layers 36 which form the backs of the flying plate devices 12. As shown, 8 detonation cords 40 of the same length and material connect the 8 identical booster explosives 36 to a single detonator 42.

Referring to FIGS. 2A and 2B, the rectangular metal plate 14 of the flying plate device 12 is preferably made of copper or a copper alloy. The plates are of uniform thickness throughout. The thickness is preferably in the range of from about ⅛ to about ¼ inches. The metal plate 14 can be inexpensively cold formed from copper or copper alloy sheets of the desired uniform thickness by means of a die. Copper is the preferred material. The purity of the copper is not critical and ordinary commercial grade copper is preferred because of its low cost. Alloys containing from about 90 to less than 100 weight percent copper may be used to manufacture the plate.

The length of the flying plate device 12 and thus the rectangular metal plate 14 is preferably limited to 12 inches. It is desirable that the detonation wave initiated by the booster explosive 38 in the high energy plastic bonded explosive layer 36 does not travel more than 6 inches. The width of the flying plate 12 should be from 2 to 6 inches when the barrier target is a sheet of metal such as rolled homogenous armor (RHA), the minimum width of the metal plate 14 is determined by the thickness of the metal target. Table 1 provides a guide to the minimum thick of the metal flying plate.

TABLE 1

| minimum width copper flying plate (inches) | thickness of RHA steel (inches) |
|---|---|
| 2.0 | 1 |
| 4.0 | 2 |
| 5.0 | 3 |
| 6.0 | 4 |

Referring to FIG. 2B, the ratio radius of curvature of concavity (Rc) of the flying plate 14 to the width (W) of the plate 14 should preferably be in the range of from about 0.5 to about 1.0. Optimum Rc is determine by the thickness of the target as shown in Table 2.

TABLE 2

| Rc (inches) | Thickness RHA steel target (inches) |
|---|---|
| 1.5 | 1 |
| 2.0 | 2 |
| 3.00 | 3 |
| 3.30 | 4 |

The radius of curvature of concavity of the flying plate 14 determines the effective stand off distance of the polygonal breaching device 10 from the target. Table 3 relates effective standoff distance to radius of curvature of concavity and width.

TABLE 3

| Rc/W Ratio | stand off distance |
|---|---|
| Rc/W > 1 | 6 to 10 feet |
| ⅔ < Rc/W ≦ 1 | 3 to 6 feet |
| ½ < Rc/W ≦ ⅔ | 2 to 3 feet |
| Rc/W = ½ | 0.5 to 2 feet |

The uniform layer of strong, flexible elastomeric material 34 shown in FIG. 2B can be bonded to the copper plate 14 by conventional means such as ordinary rubber cement or the rubber (e.g., silicone rubber) may be painted on and then cured. This elastomeric layer 34 reduces the fragmentation of the copper plate 14 and thus increases the power of the flying plate 14 to penetrate barriers. The performance of the flying linear plate decreases as the uniform thickness of the elastomeric layer 34 is increased above 0.200 inches. The uniform thickness of the elastomer layer is preferably from 0.040 to 0.200 of an inch and more preferably from 0.040 to 0.070 of an inch. The layer of elastomeric material is of uniform thickness as this is necessary for the reliable performance of the flying plates. A wide variety of strong, flexible elastomeric materials are suitable for use in these rectangular flying plate devices. For example, rubbers as diverse as silicone rubbers and Buna-N nitrile rubber (a butadiene-acrylonitrile copolymer) will work well. Rubber from old automobile inner tubes will also work well.

Referring again to FIG. 2B, the layer of energetic plastic bonded explosive 36 is attached to and covers the back of the elastomeric layer 34. It is critical that the layer of plastic bonded explosive be of uniform thickness throughout. If it is not, the linear flying plate will be unstable and its effectiveness greatly reduced. Any high energy explosive may be used in the rectangular flying plate devices. High energy plastic bonded explosives are preferred because they are easily molded to form a layer on the back of the device. C-4 is preferred because it is inexpensive and readily available. A new high energy plastic bonded explosive PBXN-110 developed by the U.S. Navy can also be used.

The weight ratio of the plastic bonded explosive 36 to the metal plate 14 is preferably from 1:1 to 5:1, more preferably 1:1 to 4:1, and still more preferably 2:1 to 4:1. For targets that are less than 1 inch thick steel or rolled homogenous armor (RHA)the weight ratio of explosive to metal plate is preferably 1:1. For targets that are 1 to 2 inches thick steel or RHA, the weight ratio of explosive to metal plate is preferably 2:1. For targets that are 2.5 to 4 inch thick steel or RHA, the weight ratio of explosive to metal plate is preferably 4:1.

Referring again to FIG. 1, it is important that all the flying plate devices in the polygonal breaching device be arranged and oriented so that when the breaching device 10 is place parallel to a flat surface target and fired, all the flying plates 14 will simultaneously strike the surface at the normal. This will be achieved if all the edges (26, 28, 30, and 32) of all the rectangular metal plates 14 lie in a single plane with the concave faces of metal plates facing forward. Thus, or an octagonal breaching device all 32 (4×8) front edges must be in the plane of the octagon.

Conventional means are provided to simultaneously detonate all rectangular flying plate devices. For example equal lengths of the same type sensitized detonation cord 40 (see FIG. 3) can be used to connect each of the booster explosives 38 to the single detonator 42. Because the flying plate devices 12 are identical, the simultaneous detonation of the devices 12 result in the flying plates 14 simultaneously striking the target barrier.

Obviously, other modifications and variations of the present invention may be possible in light of the foregoing teachings. It is therefore to be understood that within the scope of the appended claims the invention may be practiced otherwise than as specifically described.

What is claimed is:

1. A breaching device comprising:

A. a regular polygon structure of four or more sides wherein each side is formed by a rectangular flying plate device having its long axis corresponding to the polygon side, wherein the rectangular flying plate devices are identical and each comprise (1) a metal plate of uniform thickness (T) having a concave front face with the radius of curvature of concavity (Rc) being perpendicular to the long axis of the rectangular plate, the metal is copper or a copper alloy containing from about 90 to less than 100 weight percent of copper, the thickness (T) of the plate being from about ⅛ to about ¼ inches, the width being from about 2 to about 6 inches, the length being from equal to the width up to about 12 inches, and the ratio of the radius of curvature of concavity (Rc) to the width (W) being preferably from about 0.5:1 to about 1:1;

(2) a uniform layer of a strong, flexible, elasomeric material which is attached to and covers the convex back of the metal plate; and (3) a uniform layer of an energetic plastic bonded explosives which is attached to and covers the back of the elastomeric material and wherein the weight ratio of the energetic plastic bonded explosive to the metal plate is from about 1:1 to about 5:1;

wherein the rectangular flying plates are oriented to fly in the same direction in parallel trajectories that are perpendicular to the plane of the regular polygon when detonated;

B. a strong, rigid, lightweight structure which holds the flying plates in position; and C. means for simultaneously detonating all the rectangular flying plates.

2. The breaching device of claim 1 wherein the regular polygon has from 4 to 12 sides.

3. The breaching device of claim 2 wherein the regular polygon has from 6 to 10 sides.

4. The breaching device of claim 3 wherein the regular polygon has 8 sides.

5. The breaching device of claim 1 wherein the rectangular plates are copper.

6. The breaching device of claim 5 wherein the metal plates are a copper alloy containing from about 90 to less than 100 weight percent.

7. The breaching device of claim 1 wherein the weight ratio of the plastic bonded explosive to the metal plate is from 1:1 to 4:1.

* * * * *